US011615770B2

(12) United States Patent
Snyder

(10) Patent No.: US 11,615,770 B2
(45) Date of Patent: Mar. 28, 2023

(54) PERCUSSIVE RESPONSE UNIT

(71) Applicant: Alan T. Snyder, Eastern Passage (CA)

(72) Inventor: Alan T. Snyder, Eastern Passage (CA)

( * ) Notice: Subject to any disclaimer, the term of this patent is extended or adjusted under 35 U.S.C. 154(b) by 0 days.

(21) Appl. No.: 17/687,507

(22) Filed: Mar. 4, 2022

(65) Prior Publication Data

US 2022/0383839 A1 Dec. 1, 2022

Related U.S. Application Data

(60) Provisional application No. 63/193,494, filed on May 26, 2021.

(51) Int. Cl.

| | |
|---|---|
| ***G10D 13/04*** | (2006.01) |
| ***G10D 13/14*** | (2020.01) |
| ***G10D 13/08*** | (2020.01) |

(52) U.S. Cl.
CPC ..... *G10D 13/14* (2020.02); *G10D 13/08* (2013.01)

(58) Field of Classification Search
CPC ..... G10D 13/14; G10D 13/08
See application file for complete search history.

(56) References Cited

U.S. PATENT DOCUMENTS

| | | | | | |
|---|---|---|---|---|---|
| D318,680 | S * | 7/1991 | Cohen | D17/22 | |
| 6,005,177 | A * | 12/1999 | Malta | G10K 1/071 | 84/404 |
| 6,555,736 | B1 * | 4/2003 | Delosreyes | G10D 13/24 | 84/402 |
| 8,669,453 | B2 * | 3/2014 | Garrison | G10D 13/11 | 84/411 R |
| 8,912,417 | B2 * | 12/2014 | Krol | G10D 13/14 | 84/418 |
| 10,699,683 | B2 * | 6/2020 | Snyder | G10D 13/06 | |
| 2009/0064843 | A1 * | 3/2009 | Miller | G10D 13/14 | 84/410 |
| 2011/0083543 | A1 * | 4/2011 | Peterson | G10D 13/06 | 84/422.3 |
| 2022/0383839 | A1 * | 12/2022 | Snyder | G10K 3/00 | |

* cited by examiner

*Primary Examiner* — Robert W Horn
(74) *Attorney, Agent, or Firm* — Douglas Denninger

(57) ABSTRACT

A percussive response unit, and percussion instruments with same, including a rod having a rod shaft and a first retaining element, such a first head, disposed at a first rod end and having a first head width. At least a first striker set of at least one striker is disposed along a first portion of the rod shaft and is positionable near the first head. Each striker defines an opening that is larger than the outer diameter of the rod shaft to enable at least one direction of movement. A second retaining element such as a second head is connected to the second rod end to secure the first striker set on the rod shaft. Other embodiments include percussion instruments with multiple internal resonance cavities, internal resonance members, and internal and/or external strikers.

20 Claims, 12 Drawing Sheets

PERCUSSIVE RESPONSE UNIT

CROSS-REFERENCE TO RELATED APPLICATION

This application claims priority to U.S. Provisional Application No. 63/193,494 filed on 26 May 2021. The entire contents of the above-mentioned application are incorporated herein by reference.

FIELD OF THE INVENTION

This invention relates to percussion instruments and more particularly to hand-held rhythm instruments that are shaken and/or struck by hand.

BACKGROUND OF THE INVENTION

There are a number of percussion instruments that produce sound by having two elements that strike against each other, such a pair of cymbals, or by being shaken, such as a rattle with beads, bells, or jingles of a tambourine. Rhythm shakers in various forms are often used in the rhythm sections of orchestras and other musical groups to establish rhythm or to provide musical texture in musical performances. Rhythm shakers, also known as shakers or musical shakers, are used into virtually every form of music A typical rhythm shaker is a hollow container or shell, having a number of relatively small percussive media, such as metal shot, plastic beads, seeds or small stones, contained therein. The percussive media occupies a relatively small proportion of the internal volume of the rhythm shaker. A rhythm shaker is operated by shaking it back and forth or around. As such, when the rhythm shaker is operated in this manner, the percussive media through inertia, hits the inside surface of the container or shell which produces a percussive sound. When this action is repeated, the sound produced establishes rhythm in musical performances and can add dimension to music.

Rhythm shakers known in the prior art are typically constructed of various materials including plastic, wood, metal, or ceramics and have a consistent shell thickness such that a consistent sound is produced when the percussive media strikes the shell, regardless of (i) the position of where the percussive media strikes the shell, (ii) the orientation of the rhythm shaker, and (iii) the direction of the shaking of the rhythm shaker.

Thus, a disadvantage present with most conventional rhythm shakers is that only a single tone or timbre or type of sound may be produced by a single rhythm shaker. Consequently, there exists a need for a rhythm shaker-type instrument that is more versatile.

A prior rhythm shaker invention by the inventor of the present invention is disclosed in U.S. Pat. No. 10,699,683 B2 wherein percussive media strikes one portion of an outer shell of a rhythm shaker to make a particular sound when the shaker is moved in one direction yet, when the shaker is moved in another direction, the percussive media strikes a different portion of the outer shell to make a different particular sound. This allows the musician to play differing shaken-type sounds or tones or timbres with a single rhythm shaker.

It is therefore desirable to provide a more versatile percussion instrument which provides additional types of sounds.

SUMMARY OF THE INVENTION

An object of the present invention is to provide a more versatile hand-held percussion instrument which provides multiple types of sounds.

Another object of the present invention is to provide such an instrument which produces different sounds depending on how the instrument is manipulated.

This invention features a percussive response unit including a rod having a rod shaft and a first retaining element, such as a first head, disposed at a first rod end and having a first head width. At least a first striker set of at least one striker is disposed along a first portion of the rod shaft and is positionable near the first head. Each striker defines an opening that is larger than the outer diameter of the rod shaft to enable at least one direction of movement. A retaining element such as a second head is connected to the second rod end to secure the first striker set on the rod shaft.

In a number of embodiments, the retaining element includes a second retaining element, such as a second head, having a second head width, and a second striker set of at least two strikers is disposed along a second portion of the rod shaft and positionable near the second head, each striker defining an opening that is larger than the outer shaft diameter. In certain embodiments, each of at least two of the strikers in each striker set has a flat surface, and the flat surface of one striker is arranged to contact the flat surface of the other striker. In some embodiments, each of at least two of the strikers in each striker set is a planar disk, such as a circular metal washer, defining a first flat surface on one side and a second flat surface on an opposing side of the disk.

In a number of embodiments, at least two of the strikers in each striker set have widths that are different from each other. In some embodiments, each striker set has a first-width striker and a second-width striker, the second-width striker being positioned along the rod shaft farther from the respective head than the first-width striker and the second-width striker having a larger width than the first-width striker.

In certain embodiments, at least one of the first head and the second head are selectively removable from the rod and re-attachable to the rod to enable installation and/or replacement of at least one striker, such as substitution of one type of striker for another type of striker (e.g., different dimensions and/or material of composition). In some embodiments, the response unit further includes at least a first biasing member positioned along an active portion of the rod shaft. In a number of embodiments, the first biasing member is a coil spring which surrounds the active portion of the rod shaft. In one embodiment, a portion of the first biasing member is adapted to contact one of the first head and the second head.

This invention also features a percussion instrument including an acoustic resonator defining at least a first passageway having a first passageway diameter and extending between a first resonator surface and a second resonator surface. At least one percussive response unit has: (A) a rod having a rod shaft extending between first and second ends of the rod, and a first head at one end of the rod and having a first head width, the shaft having an outer shaft diameter that is accommodated by the first passageway diameter; (B) a first striker set of at least two strikers positionable along a first length of the rod shaft and near the first head, each striker defining an opening that is larger than the outer shaft diameter and smaller than the first head width; and (C) a retaining element connected to the second rod end to secure the first striker set on the rod shaft.

In certain embodiments, the retaining element includes a second head, and the percussion instrument further includes (D) a second striker set of at least two strikers positionable along a second length of the rod shaft, each striker defining an opening that is larger than the outer shaft diameter. In some embodiments, the first passageway is defined by a solid portion of the acoustic resonator, and the first resonator surface is a first outer surface of the resonator, and the second resonator surface is a second outer surface of the resonator. In other embodiments, the first passageway has a first resonator opening defined by a first resonator wall and a second resonator opening defined by a second resonator wall, and at least a first chamber is defined between the first resonator wall and the second resonator wall. In certain embodiments, each striker set has a first-width striker and a second-width striker, the second-width striker being positioned along the rod shaft closer to the acoustic resonator and farther from the respective head than the first-width striker, and the second-width striker having a larger width than the first-width striker.

This invention further features a percussion instrument with multiple internal resonance cavities, including an acoustic resonator defining at least a first passageway having a first passageway diameter and extending between a first outer wall having a first external surface and a second outer wall having a second external surface. At least one internal resonance member extends transversely to the first passageway and has (i) a first resonator surface defining a first resonance cavity between the first outer wall and the first resonator surface and (ii) a second resonance surface bounding a portion of a second resonance cavity. A rod having a rod shaft extending along the first passageway and having a first rod end and a second rod end. At least a first internal striker is positioned along the rod shaft and in the first resonance cavity or in the second resonance cavity. An air gap is established along at least a portion of the rod shaft to enable at least one striker to move at least one of (i) transversely to the rod longitudinal axis and/or (ii) axially along the rod longitudinal axis.

In some embodiments, the percussion instrument includes a plurality of internal resonance members. In certain embodiments the internal resonance members have the same dimensions and, in other embodiments, the members differ in at least one property such as length, thickness, material, and/or cavity dimension. One or more external strikers may also be utilized according to the present invention.

BRIEF DESCRIPTION OF THE DRAWINGS

In what follows, preferred embodiments of the invention are explained in more detail with reference to the drawings, in which.

DETAILED DESCRIPTION OF THE PRESENTLY PREFERRED EMBODIMENTS

Figure 1A:
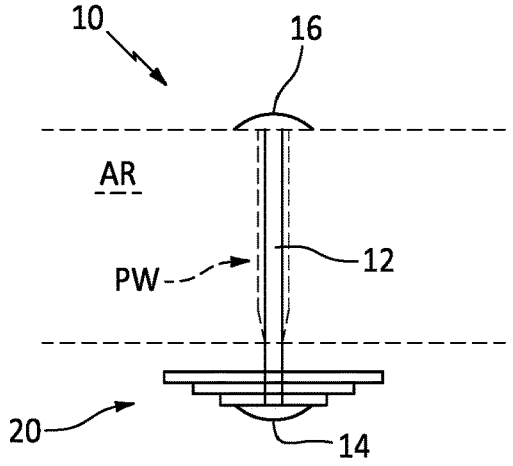
FIG. 1A is a schematic side elevational view of a percussive response unit according to the present invention, in relation to an acoustic resonator shown in phantom to represent a solid or a hollow body, having a single striker set positionable against one head of a rod with another head at the opposite end of the rod being capable of directly contacting the acoustic resonator.

This invention may be accomplished by one or more percussive response units, and percussion instruments with same, including a rod having a rod shaft extending from a first rod end to a second rod end. A first retaining element such as a first head is disposed at the first rod end and has a first head width. At least a first striker set of at least at least one striker, typically two or three strikers, is disposed along a first portion of the rod shaft and is positionable near the first head. Each striker defines an opening that is larger than the outer diameter of the rod shaft to enable at least one direction of movement. A retaining element such as a second head is connected to the second rod end to secure the first striker set on the rod shaft and to secure the response unit relative to a percussion instrument utilizing same. When a striker is positioned directly against the first head, then that striker has an opening that is smaller than the first head width. In a number of constructions, a second striker set of at least one striker is disposed along a second portion of the rod shaft and positionable near the second head, each striker defining an opening that is larger than the outer shaft diameter.

The term "air gap" as utilized herein refers to an empty space established along at least a portion of the rod shaft to enable at least one striker to move at least one of (i) transversely to the rod longitudinal axis and/or (ii) axially along the rod longitudinal axis. In certain constructions, the air gap is a spacing between at least one striker set and an external wall of an acoustic resonator. In some constructions, a coil spring or other biasing element occupies some or all of the air gap, and compresses during movement of the percussion instrument in the direction of the longitudinal axis.

The terms "back and forth" and "up and down" as utilized herein refer to movement of a percussion instrument relative to an upright user (either standing up or seated) relative to ground ("earth"), with the user holding the percussion instrument with each rod substantially parallel to ground. The term "back and forth" (also referred to as "to and fro") is generally horizontal movement, such as pushing away from one's body and, once extended to the desired position, then brought back towards one's body. The term "up and down" meaning—"up" is to pull away from the earth, and "down" is to pull towards the earth.

The terms "cavity" and "chamber" as utilized herein refer to spaces defined with a percussion instrument. A "chamber" is a totally enclosed space or void, whereas a "cavity" is a void bounded on at least two sides. One chamber contains multiple cavities in some constructions. A cavity may also be referred to herein as a "gap" defined between two elements such as internal resonance members.

The terms "near" and "proximate to" as utilized herein encompass placement of a first object such as a striker in close proximity to or against a second object such as a head of a rod. An intervening object such as a biasing member, a spacer and/or a decorative "finish" washer may be positioned between the first object and the second object.

The term "portion" as utilized herein refers to a section or region of a component, without necessarily indicating any physical difference between two or more portions apart from location such as "upper portion" and "lower portion".

The term "retaining element" as utilized herein encompasses features which retain one or more strikers on a rod. In some constructions, the retaining element is an enlarged feature such as a head that is fixed to one end of the rod in certain constructions and, in other constructions, is selectively removable utilizing mating male/female components such as a threaded male projection on the head and a corresponding threaded socket in the end of the rod. Detents and recesses of various types can also be utilized to secure the enlarged feature to the rod. In yet other constructions, a portion of a body of a percussion instrument serves as the enlarged feature, and an end of the rod has a frictional engagement with that portion of the body such as via a compression fit, a threadable engagement, or an adhesive attachment.

The term "rod" as utilized herein is a synonym of "bar", that is, a solid, substantially rigid object having a substantially uniform cross-section that is smaller than its length. Although rods as utilized in response units according to the present invention are typically cylindrical metal rods, other shapes and materials can be utilized within the spirit of the invention, including objects having polygonal cross-sections and/or one or more tapers in cross-section along their length.

The term "spring action" as utilized herein refers to a rebounding or "bouncing" movement, also referred to as a "responsive action", provided to one or more strikers by at least one biasing member such as a coil spring or an elastomeric element.

The term "substantially" as utilized herein encompasses deviations of up to ten percent, such as a top surface and a bottom surface or opposing sides being "substantially parallel" or "substantially uniform" encompassing deviations up to ten degrees from each other, or "substantially perpendicular" encompassing an angle from 80 degrees to 100 degrees from a reference surface.

A percussion instrument according to the present invention has one or more percussive response units, also referred to herein as striker assemblies, installed on an acoustic resonator, also referred to herein as a body, that is solid in some constructions and, in other constructions, defines one or more chambers and/or cavities which can be empty or can contain percussive media such as one or more types of beads. This invention may also be expressed as a shaker-style instrument having a body and at least one striker assembly. An air gap is established along at least a portion of the rod shaft to enable at least one striker to move at least one of (i) transversely to the rod longitudinal axis and/or (ii) axially along the rod longitudinal axis.

In some constructions, the body has different thicknesses of walls that create slightly different timbre when internal beads hit the different walls of the body. In certain constructions, the body has one or more internal resonance members, also referred to as internal sound board projections or "sound boards"; some constructions of instruments with sound boards utilize rods without heads and/or without external strikers as described in more detail below. Optional spring action response is provided in some constructions to give the instrument responsive action when played in a back-and-forth motion (internal). One or more sets of external, preferably multiple-size strikers such as washers, slide back and forth on a rod can be controlled by a skilled player to create clicking patterns in music with a bright sound. As the strikers are very close to the body when played in back-and-forth and/or circular "spin" motions, the user can use different activation techniques including very quick hits.

When playing the shaker in a to-and-fro motion, it creates clicking type sounds as the strikers sliding up and down the rod hitting the acoustic resonator. By adding a small circular motion in with your arm or wrist parallel to the longitudinal axis of the rod, this makes the strikers spin around the rod on the circumference of the passageway (sideways motion) perpendicular to the rod, as the strikers spin they can create a constant underlying sound (a rubbing type sound). This sound can be controlled by a skilled player to be constant or intermitted to blend into an overall instrument sound.

Another style of playing and sound is using a flicking type motion with your wrist and fingers, with very quick and sudden stops in the motion this can create a very tight clean sound, all the different styles of play and all the different sounds that can be generated by turning the shaker slightly at different angles, can be blended to create an overall instrument sound.

A percussive response unit 10 according to the present invention, FIG. 1A, is shown in relation to an acoustic resonator AR, shown in phantom to represent a solid body or, in other constructions, a hollow body. A passageway PW is shown in dashed lines about a rod 12. Response unit 10 has a single striker set 20 positionable against one head 14 of the rod 12 with another head 16 at the opposite end of the rod being capable of directly contacting the acoustic resonator AR in this construction.

Figure 1B:
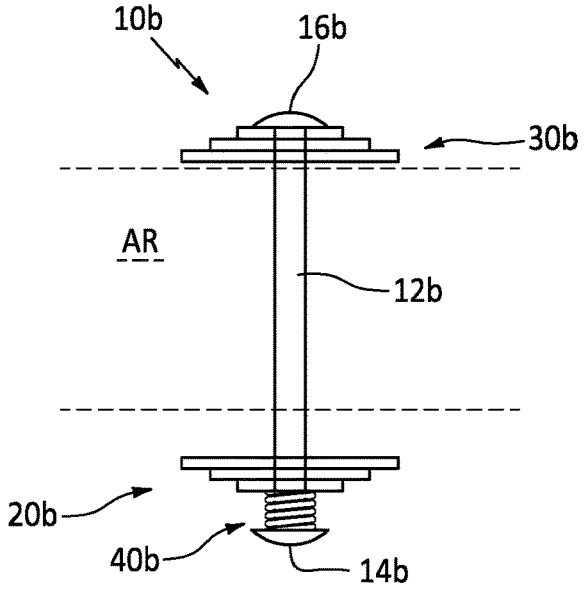
FIG. 1B is a schematic side view similar to FIG. 1A of an alternative response unit having opposing striker sets and a coil spring as a biasing member.

An alternative response unit 10*b*, FIG. 1B, has opposing striker sets 20*b*, 30*b* and a biasing member 40*b* along a rod 12*b*. Each of striker sets 20*b*, 30*b* includes three individual strikers in this construction, with different widths as described below. The strikers and the biasing member 40*b* are secured by heads 14*b* and 16*b* after one or both heads are re-attached to the rod 12*b*.

Figure 2:
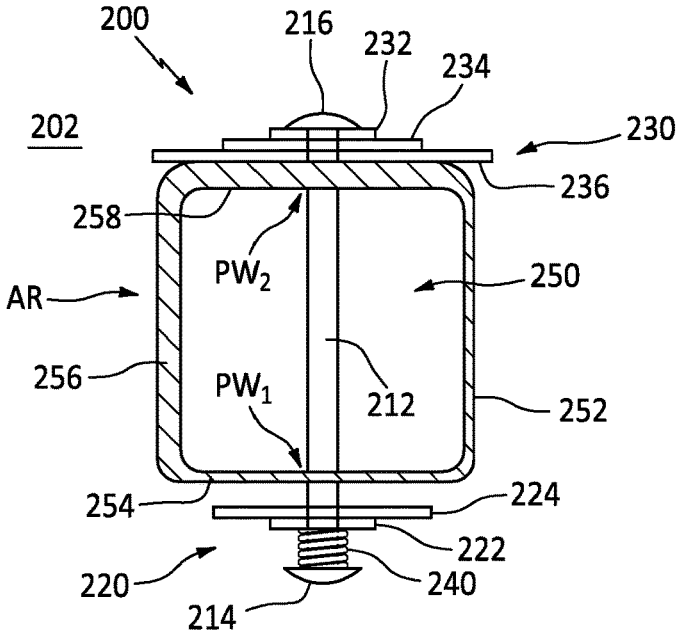
FIG. 2 is a schematic end elevational view of a percussion instrument with an alternative response unit according to the present invention installed on an acoustic resonator with a hollow chamber shown in cross-section defined by walls of differing thicknesses.

A percussion instrument 202, FIG. 2, has an alternative response unit 200 installed on an acoustic resonator AR, also referred to as a body AR, through a hollow chamber space 250 shown in cross-section defined by walls 252, 254, 256 and 258 of differing thicknesses such as disclosed in U.S. Pat. No. 10,699,683 B2 by the present inventor, which is incorporated herein in its entirety. In some constructions according to the present invention, the chamber 250 of acoustic resonator AR remains otherwise empty and, in other constructions, one or more types of percussive media are included. In yet other constructions, space 250 represents one or more cavities.

Rod 212, FIG. 2, has one head 214 which abuts coil spring 240 and supports a first striker set 220 including a first washer 222 and a second washer 224. In some constructions, a thin "finish" washer, also referred to as a "footing" washer, is placed between the coil spring 240 and the first washer 222, with a central opening in the finish washer having a tighter tolerance with the outer rod diameter as compared with larger central openings of the washers 222 and 224. A head 216 abuts a second striker set 230 including a first washer 232, a second washer 234 and a third washer 236. As illustrated in FIG. 2, the individual strikers of sets 220, 230 have widths that increase more substantially progressing towards acoustic resonator AR than the gradual increases in width shown in FIGS. 1A and 1B for striker sets 20 and 20*b*, 30*b*, for example.

Body wall 254 defines a first passageway opening $PW_1$ and wall 258 defines a second passageway opening $PW_2$. When the width of openings $PW_1$ and $PW_2$ are slightly larger than the shaft diameter of rod 212, then rod 212 is allowed to rattle within the body AR when the instrument 202 is shaken by a user.

Figure 3:
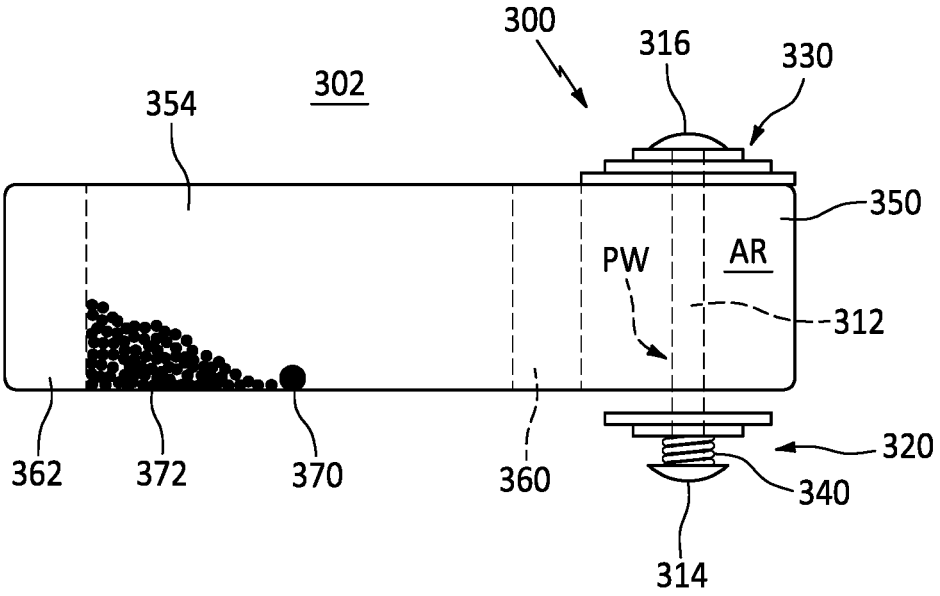
FIG. 3 is a side, partial cross-sectional view of a shaker according to the present invention having a single response unit with external strikers and a chamber with percussive media.

A shaker 302 according to the present invention, FIG. 3, has a single response unit 300 with external striker sets 320, 330 and a chamber 354 with percussive media. A shaker 402 according to the present invention, FIGS. 4-5, has two response units 400, 401 with external striker sets 420, 430 and 421, 431 on either side of acoustic resonators $AR_1$ and $AR_2$ that are separated by a chamber 454 with percussive media. Striker set 320, FIG. 3, has a coil spring 340; striker sets 420, 421, FIG. 4, have coil springs 440, 441, respectively, in the illustrated constructions. As shown in FIG. 5, striker set 430 has three stacked washers 432, 434 and 436 while striker set 431 has three stacked washers 433, 435 and 437.

Both shakers 302 and 402 are substantially hollow with elastomeric plugs 360, 362 and 460, 462 establishing different chambers. For example, plug 360, FIG. 3, separates chambers 350 and 354; chamber 354 is bounded at its opposite end by plug 362 and contains percussive media as described in more detail below. Similarly, plug 460, FIG. 4, separates chambers 450 and 454; chamber 454 is bounded at its opposite end by plug 462 and contains percussive media.

Rod 312 extends through passageway PW which includes holes defined in opposing walls around chamber 350; rods, 412, 413 extend through passageways $PW_1$ and $PW_2$, respectively. When the passageway in the body is slightly larger than the rod diameter, the rod can also rattle in the body in a manner which can be controlled by a skilled player. In other words, at least one degree of freedom of movement can be established between the rod shaft and the passageway.

Figure 10:
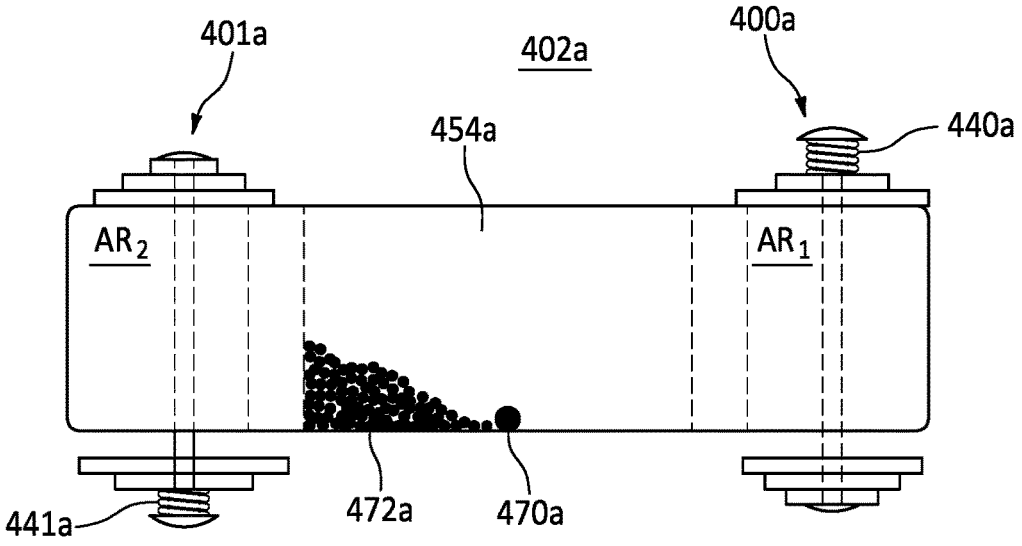
FIG. 10 is a schematic side elevational, partial-cross-sectional view similar to FIG. 4 of an alternative shaker having one of the response units inverted.

Percussive media in instrument 302 includes a large internal beater 370 such as a metal ball bearing and small plastic beads 372. Percussive media in instrument 402 includes beater 470 and beads 472 which include a mixture of at least two sizes and/or materials of beads in one construction; in another construction, beads 472 all have the same size and material of composition. As described below, an alternative shaker is shown in FIG. 10 having one of the response units inverted.

Figure 5:
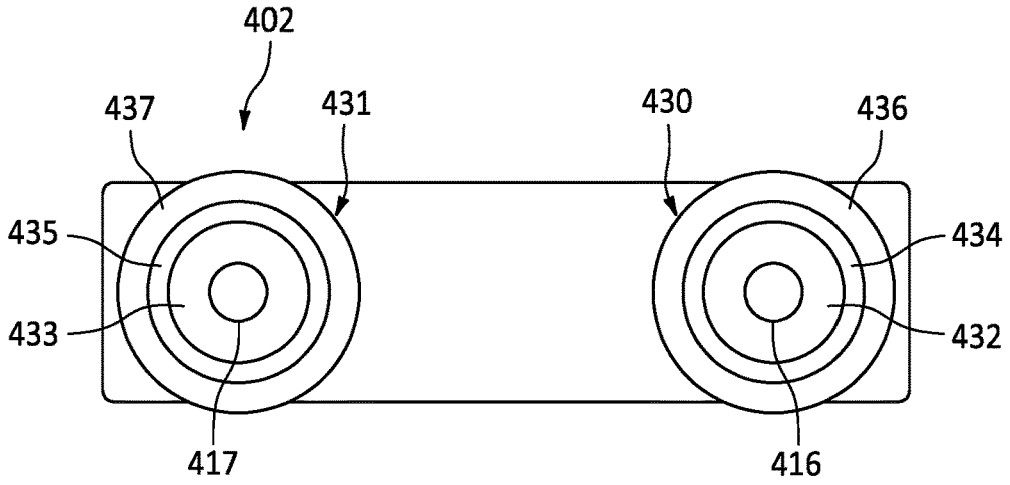
FIG. 5 is top view of the shaker of FIG. 4.
Figure 6:
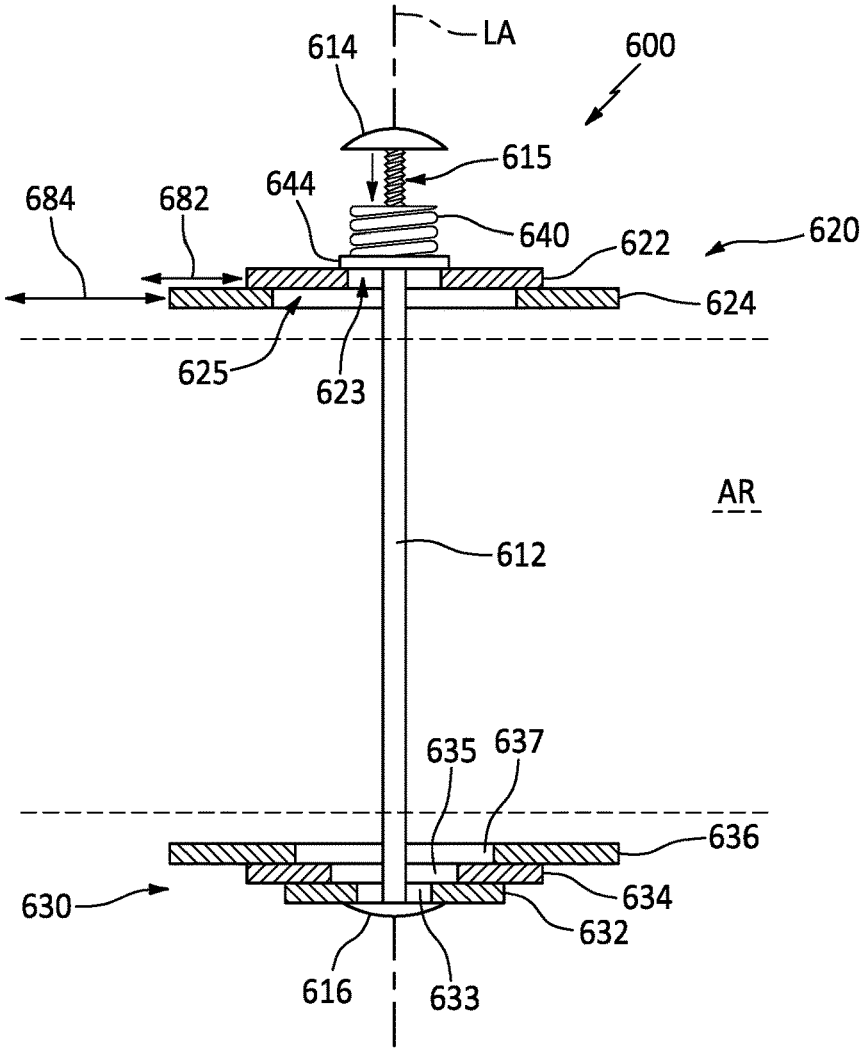
FIG. 6 is a side, partial cross-sectional view of an alternative response unit having a finish washer positioned under a coil spring and with a head shown being threadably engaged with a rod at one end.

A response unit 600, FIG. 6, has a thin finish washer 644 positioned under a coil spring 640 as part of striker set 620. A removable head 614 and a threaded male shaft 615 are shown being threadably engaged with a rod 612. Finish washer 644, typically made of a stainless-steel alloy, has an outer diameter that is larger than the opening 623 of washer 622 such that no holes are visible after assembly when viewed from above, such as illustrated in FIG. 5 for instrument 402 and in FIG. 21. Finish washer 644 typically is selected to have a central opening that is only slightly larger than the outer rod diameter so that sideways movement is limited. Washer 624, FIG. 6, defines an opening 625 that is selected to be slightly smaller than the width (outer diameter) of washer 622. Similarly, striker set 630 has washers 632, 634 and 636 of increasing width, each with holes 633, 635, 637, respectively, of increasing diameters, to enable different directions and timing of movement as described in more detail below.

Figure 6A:
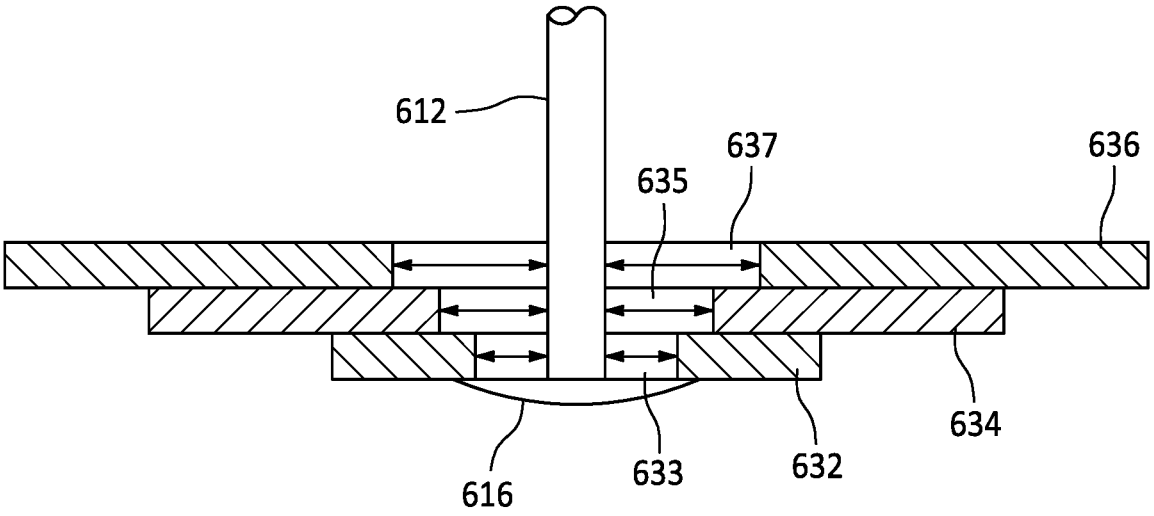
FIG. 6A is an enlarged view of the lower portion of FIG. 6 showing strikers having different openings to enable sideways motions.
Figure 11A:
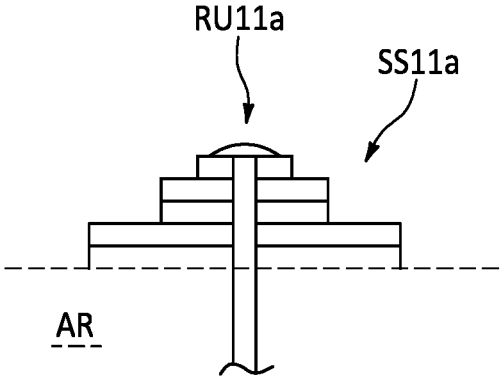
FIGS. 11A-11D are schematic side elevational views of additional striker set configurations according to the present invention.
Figure 11B:
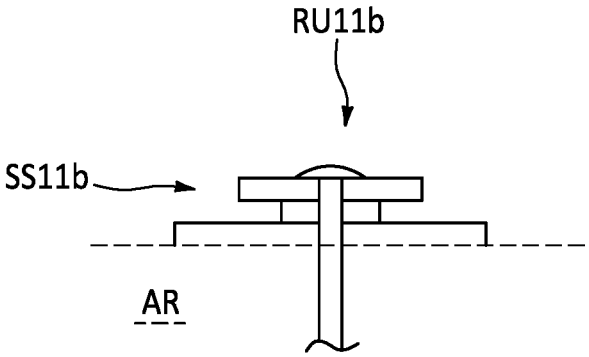
Figure 11C:
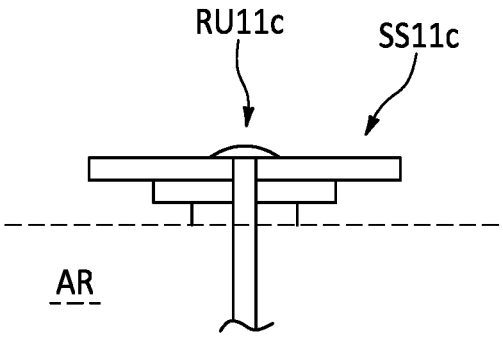
Figure 11D:
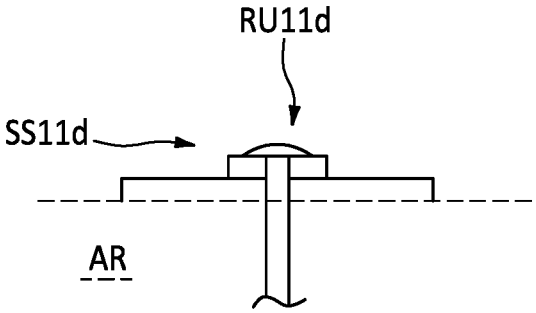

The longitudinal axis LA of rod 612 is indicated by dashed lines extending above removable first head 614 and below second head 616. The possible extent of travel of washers 622, 624 in a direction perpendicular to longitudinal axis LA is indicated by double-headed arrow 682 for washer 622 and by double-headed arrow 684 for washer 624. In this example, the length of arrows 682, 684 represent the hole diameter of openings 623 and 625 less the outer shaft diameter of rod 612. Similarly, movement possible for washers 632, 634 and 636 is shown in more detail in FIG. 6A, which is an enlarged view of the lower portion of FIG. 6 showing strikers having different openings to enable various sideways motions and/or circular "spin" motions.

Figure 7:
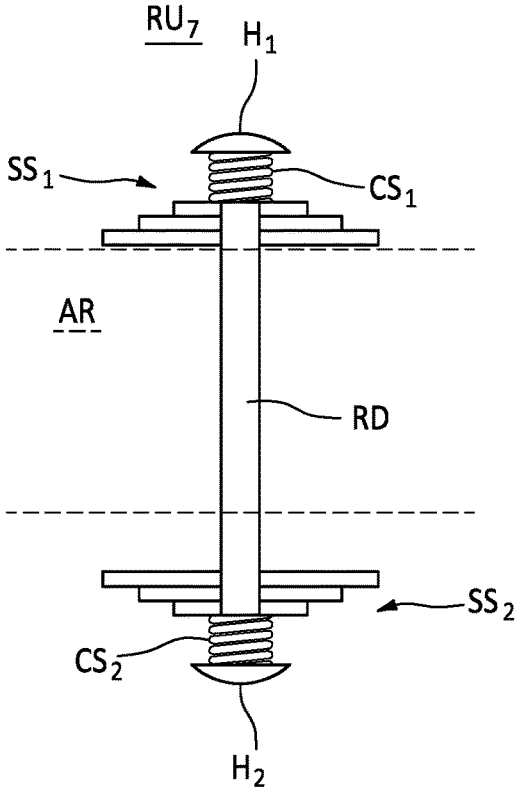
FIG. 7 is a schematic side elevational view of an alternative percussive response unit according to the present invention, in relation to an acoustic resonator shown in phantom, having opposing biasing members positioned against first and second heads of the rod.
Figure 8:
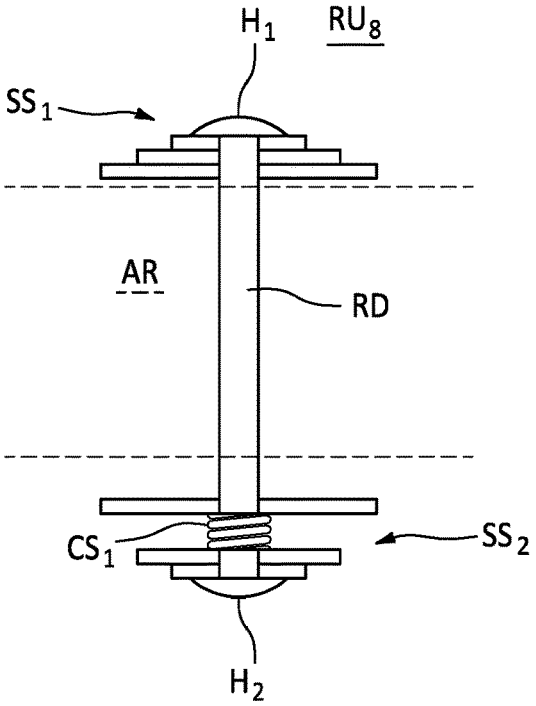
FIG. 8 is a schematic side elevational view similar to FIG. 7 of an alternative percussive response unit having a single biasing member disposed within a striker set.
Figure 9:
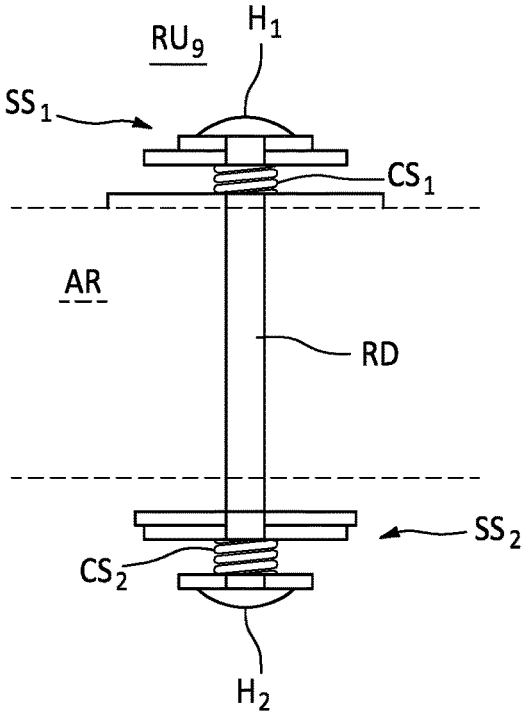
FIG. 9 is a schematic side elevational view similar to FIGS. 7 and 8 of an alternative percussive response unit having opposing biasing members, with each biasing member disposed within a striker set.

Alternative representative percussive response units $RU_7$, $RU_8$ and $RU_9$ according to the present invention, which can be substituted for any of the other percussive response units shown and described elsewhere in the present application, are illustrated in FIGS. 7-9 in relation to an acoustic resonator AR designated in phantom. "Multi-action" response unit $RU_7$, FIG. 7, has opposing coil spring biasing members $CS_1$ and $CS_2$ positioned against first and second heads $H_1$, $H_2$ of the rod RD as part of "active" striker sets $SS_1$ and $SS_2$, respectively. "Multi-position-action" response unit $RU_8$, FIG. 8, has a single biasing member disposed within a striker set $SS_2$ with strikers positioned both above and below the coil spring $CS_1$. Response Unit $RU_9$, FIG. 9, has opposing biasing members, with each biasing member disposed within a striker set $SS_1$ and $SS_2$, respectively, as a combination of the embodiments of FIGS. 7-8.

Figure 4:
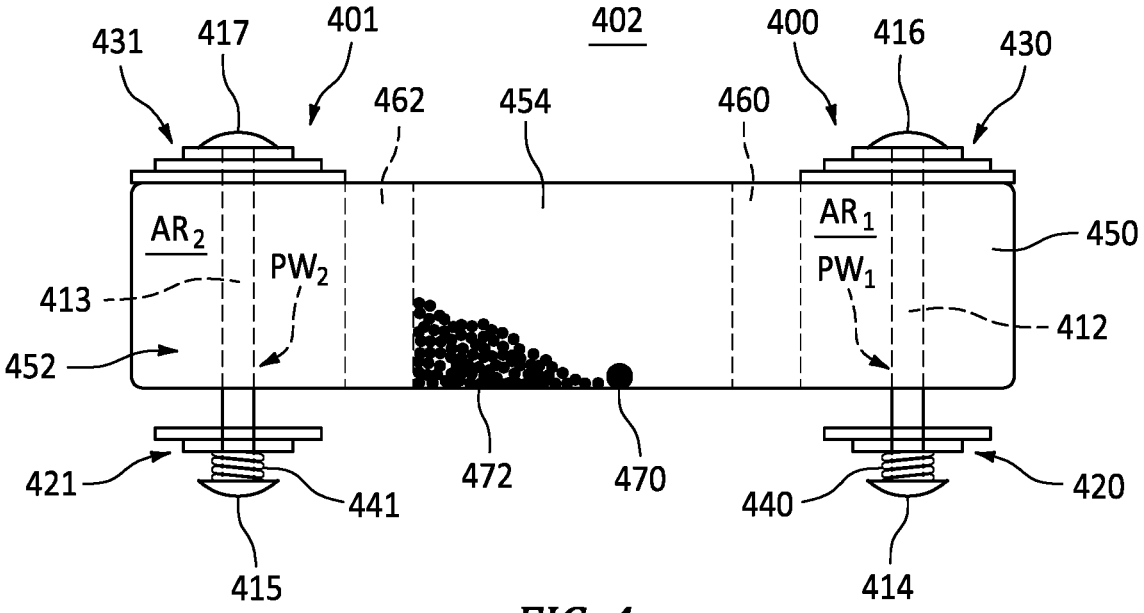
FIG. 4 is a side, partial cross-sectional view of a shaker according to the present invention having two response units with external strikers and separated by a chamber with percussive media.

A shaker 402*a*, FIG. 10, is similar to shaker 402, FIG. 4, with similar reference numerals designating similar components. In particular, shaker 402*a*, FIG. 10, has an "inverted" response unit 400*a* with biasing member 440*a* positioned above an upper exterior surface of shaker 402*a* while biasing member 441*a* of response unit 401*a* is positioned below a lower exterior surface of shaker 402*a*.

Additional striker assembly configurations SS11*a*, SS11*b*, SS11*c* and SS11*d* are illustrated in FIGS. 11A-11D for response units RU11*a*, RU11*b*, RU11*c* and RU11*d*, respectively. Representative possible outer shapes and hole (central opening) shapes are shown for strikers S12$a_1$-S12$a_4$ (square outer shape), FIG. 12A, strikers S12$b_1$-S12$b_3$ (round outer shape), FIG. 12B, strikers S12$c_1$-S12$c_4$ (triangular outer shape), FIG. 12C, and strikers S12$d_1$-S 12$d_4$ (hexagonal outer shape), FIG. 12D. Suitable hole shapes include circular "Cr", triangular "Tr", square "Sq" and hexagonal "Hx" as illustrated in FIGS. 12A-12D. The cross-section of a rod utilized with such differing striker outer- and hole-shapes and/or dimensions is typically cylindrical; however, different rod cross-sectional shapes may produce differ "lags" or delays, or otherwise change the timing and/or timbre of sounds produced according to the present invention.

In general, a rod of a response unit according to the present invention holds the strikers in selected positions along the rod, external and/or internal to a body of a percussion instrument. In some constructions, especially external to the body, there are layers of different size strikers, each of the strikers typically having different size holes relative to the other strikers in a set. This allows for different amounts of movements. When the strikers slide back and forth and hit the rod at slightly different times, it creates a layered sound when played in a up-and-down motion. In other constructions, strikers having the same width size are utilized, with the same size holes Before describing the embodiments shown in FIG. 13 onward, some of which have only internal strikers, general descriptions of most embodiments according to the present invention are provided as follows.

In certain constructions, the strikers are disks such as washers that are solid metal (such as an alloy of stainless steel) but could also be made from other composites including wood, different metals, ceramic, etc. In a number of constructions, the strikers are stacked in ascending order from the large striker hitting the body, that is, the acoustic resonator, and descending down in size toward a head of a rod for that striker set. By laying one's thumb on the stack of strikers when playing, a skilled player can allow all strikers to contact each other or only allow one layer to contact or none, this can be done by laying your thumb (finger) on the striker stack and muting their sound, by controlling the different bright sound clicks (accents) it can create selected clicking layered rhythms and/or sounds in music.

When the striker assembly lacks a spring or other biasing member, the outer diameter of the rod can be selected relative to its passageway (such as one or more holes) through the acoustic resonator such that the rod itself can be manipulated to slide back and forth (that is, along the longitudinal axis of the rod shaft) when played as one or both heads of the rod hit the respective strikers. When the passageway in the body is slightly larger than the rod diameter, the rod can also rattle in the body which can be controlled by a skilled player. In other words, at least one degree of freedom of movement can be established between the rod shaft and the passageway to provide axial and/or lateral (side-to-side) movement of the rod relative to the acoustic resonator.

The rod, which holds the strikers in place, is typically constructed in two parts: a first part including the rod shaft and one head at one end and a threaded female receptacle at the other end of the rod shaft; and a second, selectively removable head having a threaded male projection that threadably engages the female receptacle. In another construction, the rod has a male- or female-threaded connector at each end to removably secure a head at each end. The rod and heads could also be made out of one piece, with a second head being formed after installation with one or more striker sets in an acoustic resonator. After installation, the heads of the rod are larger than the holes in the strikers so that the heads contain the strikers in and on the body.

In various constructions of percussion instruments according to the present invention, the external portion of the body contains layers of different-size strikers each having different-size holes in some constructions and, in other constructions, may also be the same-size strikers with the same-size holes. Different-size holes in the strikers allows for different amounts of movements, when the strikers slide back and forth and hit the rod at slightly different times it creates a layered sound when played in an up-and-down motion.

When playing in an up-and-down motion with striker hole diameters larger than the outer shaft diameter of the rod, the strikers can slide back and forth in a sideways motion when they contact the rod at slightly different times due to the holes being different sizes in the striker. This creates a metallic click sound which can be controlled by a skilled player. Circular "spin" motions can also be utilized to provide additional types of sounds.

By pressing on the rod and allowing more movement of the external strikers, a skilled player can create more volume and accents by controlling the amount of movement in which the strikers can move. By pressing on the rod and allowing more movement of the external strikers, a skilled player can create more volume and accents by controlling the amount of movement is which the strikers can move.

The rod may be fixed on one or both ends to the body with enough space to allow free movement of the external strikers. The more force put into the back-and-forth motion when playing, then the louder one or more strikers hit the body. By laying one's fingers and/or thumb on the strikers and restrict their movement by varying degrees, a skilled player can control the impact the strikers hit the body from none existent to a full unobstructed hit.

The body can be any shape including circle/puck, triangle, square, rectangle, octagon or any other shape. Also, the body may be any size.

As the strikers slide on the rod a skilled player can have a balance of sound between a metallic- and a click-type sound, by the amount the strikers hitting the rod versus the amount that the strikers hit the body. These variations in sound are achieved by combining a back-and-forth motion to an up-and-down motion by a skilled player. The external strikers can naturally flap back and forth when played in a back-and-forth motion, by holding a portion of one's hand (such as a thumb) on them. A skilled player can create rhythmic patterns by muting and releasing the action of the strikers and/or the rod. When playing in a up-and-down motion, strikers having holes that are larger than the rod enables the strikers to slide back and forth in a sideways motion. When the strikers contact the rod, it creates a metallic sound, as can be controlled by a skilled player.

When playing in a back-and-forth motion on the back stroke the strikers hit each other in succession which creates a bright sound (similar to a hi hat) and on the forward stroke the strikers hit the body of the instrument which creates more of a wood (click) sound followed by the stickers hitting each other in succession to give the instrument a full sound.

By laying one's thumb lightly on the edge of the stack of strikers and allowing them to softly hit each other when played in a back-and-forth motion this allows a skilled player to adjust the attack and disperse of the (hi hat sound) also the player might let the bottom stack to move freely to blend in one cohesive sound.

In constructions having at least one biasing member such as a coil spring, a block or disk of natural or synthetic rubber or other elastomeric element that provides "spring action" (and/or slightly muting generated sounds, depending on the material selected for the biasing member) to one or more strikers, the spring action allows the instrument to have live action as the spring bounces back and forth on the rod it cushions the strikers from hitting the end of the rod and bounces the strikers back against the body thus creating rhythmic patterns that can be controlled by a skilled player.

The rhythm shaker can have multiple spring action assemblies allowing a skilled player to mute by holding your finger or thumb lightly on the strikers and allow the other strikers assemblies to move freely thus creating different textures (more bright/less bright and/or more click/less click) as controlled by a skilled player.

The spring action assembly can be incorporated into any body type as it does not require any other elements to create sound. The strikers hitting a solid wood body makes a lower click sound as shown in FIGS. 1A-1B, for example. In FIG. 6, the spring action assembly is put into a multi-layered instrument, wherein putting an extra striker in between each layer when moving back and forth creates a full clicking sound with slightly different timbres as the strikers hit sound boards, by having small gaps between the sound boards that the strikers hit. These gaps enable a user to create very fast click patterns by creating accents with the external strikers at the same time it creates a full sounding instrument. This can be controlled by a skilled player to create rhythmic elements in music.

When a striker assembly has a spring on one end of the rod (but could be on both ends or none) between the external strikers and the head of the rod, when played in a back and forth motion the spring creates action in the instrument and also controls the amount of movement that the external strikers can move. A skilled player can create the amount of movement on the external strikers by the action on the spring without depressing the rod as well, but by pressing on the rod and compressing the spring it allows even more back and forth moment on the external strikers which can be controlled in real time.

In certain constructions, percussive media (also referred to herein as internal fill) includes small plastic beads and one or more steel bearing approximately ¼" (e.g., typically between ⅛"-⅜") in diameter. The large bearing can add a clicking rhythm as when played back and forth. The heavier bearing can "fly" through the lighter plastic beads when in motion and creates a click that can be controlled by a skilled player to create rhythm.

The shakers shown in FIGS. 13-20 are referred to herein as "multi-cavity shakers", "multi-layer shakers" or percussion instruments having a "multi-layered body". Such shakers having one or more internal resonance members according to the present invention may be characterized as a percussion instrument with multiple internal resonance cavities, including an acoustic resonator defining at least a first passageway having a first passageway diameter and extending between a first outer wall having a first external surface and a second outer wall having a second external surface. At least one internal resonance member, also referred to herein as a "sound board", extends transversely to the first passageway and has (i) a first resonator surface defining a first resonance cavity between the first outer wall and the first resonator surface and (ii) a second resonance surface bounding a portion of a second resonance cavity. A rod having a rod shaft extending along the first passageway and having a first rod end and a second rod end. At least a first internal striker is positioned along the rod shaft and in the first resonance cavity or in the second resonance cavity.

In general, multi-layered shakers have a body is constructed by defining cavities, also referred to as gaps, between two or more internal sound boards. Preferably, one or more internal strikers slide along the rod and contact the sound boards when played in a back-and-forth motion. In some constructions, one or more external strikers are able to hit at least one outer surface of the body. The body can have unlimited sound boards as they are only limited by the number of gaps in the body.

Typically, the strikers are discs (washers) that are solid metal, but could also be made from other composites wood, different metals, ceramic, etc.

Figure 13:
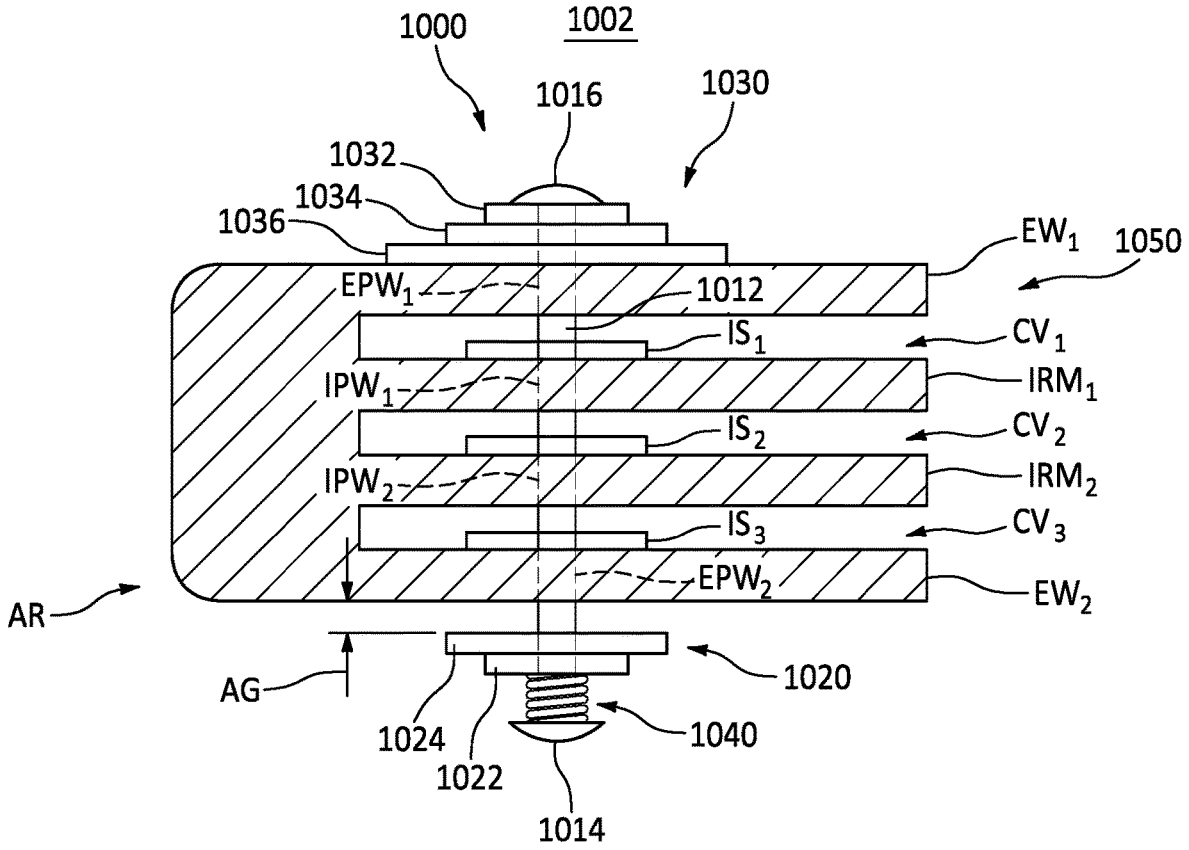
FIG. 13 is a side, partial cross-sectional view of a shaker according to the present invention having multiple internal resonance members, also referred to as a multi-layered shaker, with both internal and external strikers according to the present invention.
Figure 12A:
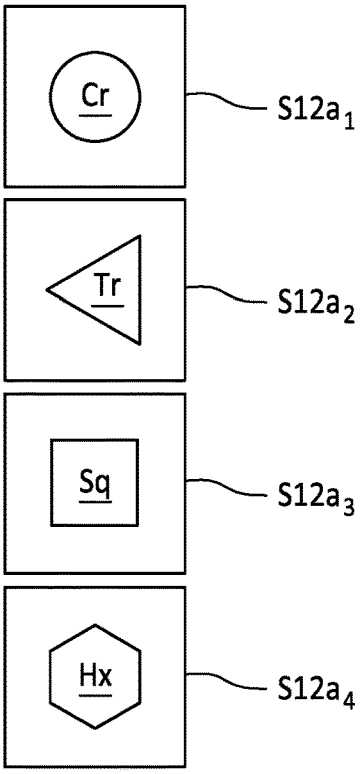
FIGS. 12A-12D are schematic top views of different striker shapes useful according to the present invention.
Figure 12B:
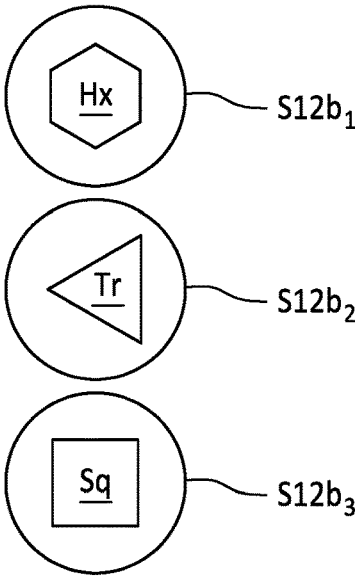
Figure 12C:
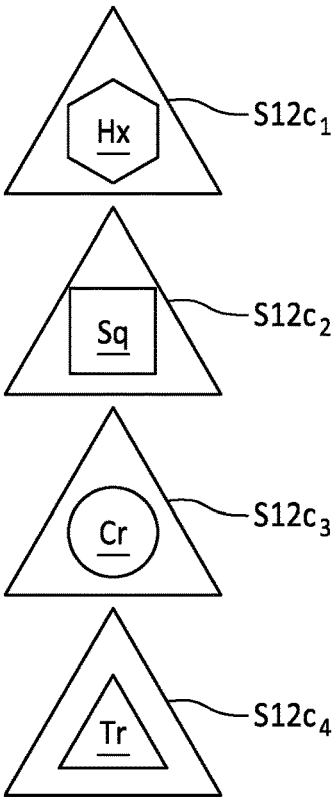
Figure 12D:
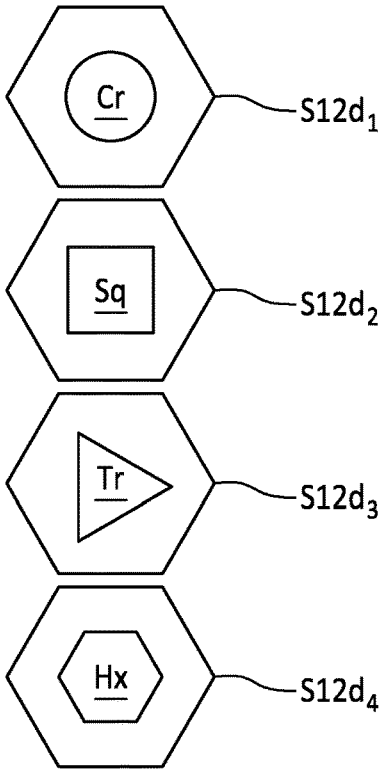
Figure 21:
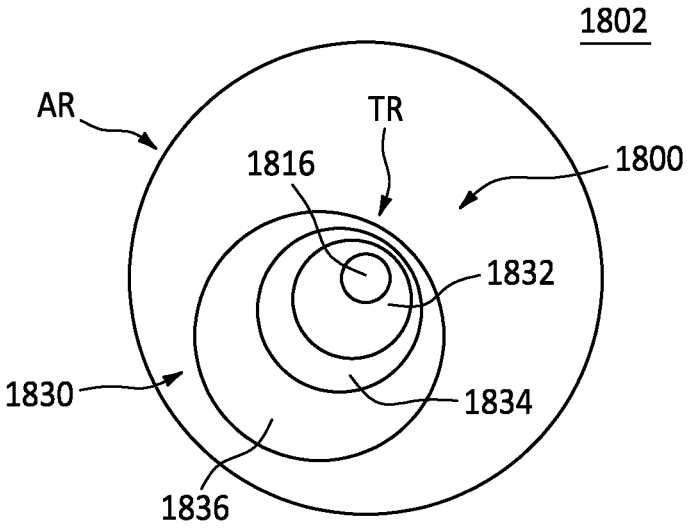
FIG. 21 is a schematic top view of a shaker according to the present invention with external strikers offset in one direction yet with no holes visible.

Shaker 1002 according to the present invention, FIG. 13, has multiple internal resonance members $IRM_1$ and $IRM_2$ in this construction. A response unit 1000 is installed on an acoustic resonator AR, also referred to as a body AR, through space 1050 representing cavities $CV_1$, $CV_2$ and $CV_3$. The cross-sectional symbol for wood is utilized for body AR in FIG. 13, but the material of construction is not a limitation of the invention. When body AR is a circular "puck" such as illustrated in FIG. 21, the sides of cavities $CV_1$, $CV_2$ and $CV_3$. are bounded only by the solid portion of body AR, with the remainder of the cavity sides open to the atmosphere; in other words, no enclosed chamber is present in this construction.

Rod 1012 has one head 1014 which abuts coil spring 1040 and supports a first striker set 1020 including a first washer 1022 and a second washer 1024. In some constructions, a thin "finish" washer is placed between the coil spring 1040 and the first washer 1022, with a central opening in the finish washer having a tighter tolerance with the outer rod diameter as compared with larger central openings of the washers 1022 and 1024. See finish washers 1144, FIGS. 14 and 1244, FIG. 15, for example. A head 1016 abuts a second striker set 1030 including a first washer 1032, a second washer 1034 and a third washer 1036. Striker sets 1020 and 1030 are concentric around rod shaft 1012.

An air gap AG is established along at least a portion of the rod shaft to enable at least one striker to move axially along the rod longitudinal axis. The air gap AG is typically at least as large as the width of one striker, such as at least 1/16 inches in one construction, preferably having a gap length less than 1/2", more preferably ranging from 1/16" to 3/8", and most preferably about 1/8 inches of air gap. Movement of strikers relative to the air gap can be controlled by a skilled player to have more movement on one set of strikers by simply holding your thumb/finger against the strikers. This allows the rod to push through to the other side of the shaker and create the gap on the opposite side so the strikers can move. This gap alternates back and forth when playing in a back-and-forth motion.

Exterior wall $EW_1$ defines a first passageway opening $EPW_1$ and exterior wall $EW_2$ defines a second passageway opening $EPW_2$. Similarly, internal resonance members $IRM_1$ and $IRM_2$ defines a first internal passageway opening $IPW_1$ and a second internal passageway opening $IPW_2$, respectively, as indicated with dashed lines. When the width of openings $EPW_1$, $EPW_2$, $IPW_1$ and $IPW_2$ are slightly larger than the shaft diameter of rod 1012, then rod 1012 is allowed to rattle within the body AR when the instrument 1002 is shaken by a user.

Further included in this construction are internal strikers $IS_1$, $IS_2$ and $IS_3$ which are also concentric around rod shaft 1012. In some constructions, internal strikers $IS_1$, $IS_2$ and $IS_3$ define central openings that all have the same diameter and, in other constructions, the dimensions of the central openings differ from each other. At a minimum, sufficient clearance is provided to enable the internal strikers $IS_1$, $IS_2$ and $IS_3$ to travel up and down, that is, along the longitudinal axis of rod shaft 1012, within cavities $CV_1$, $CV_2$ and $CV_3$.

Figure 14:
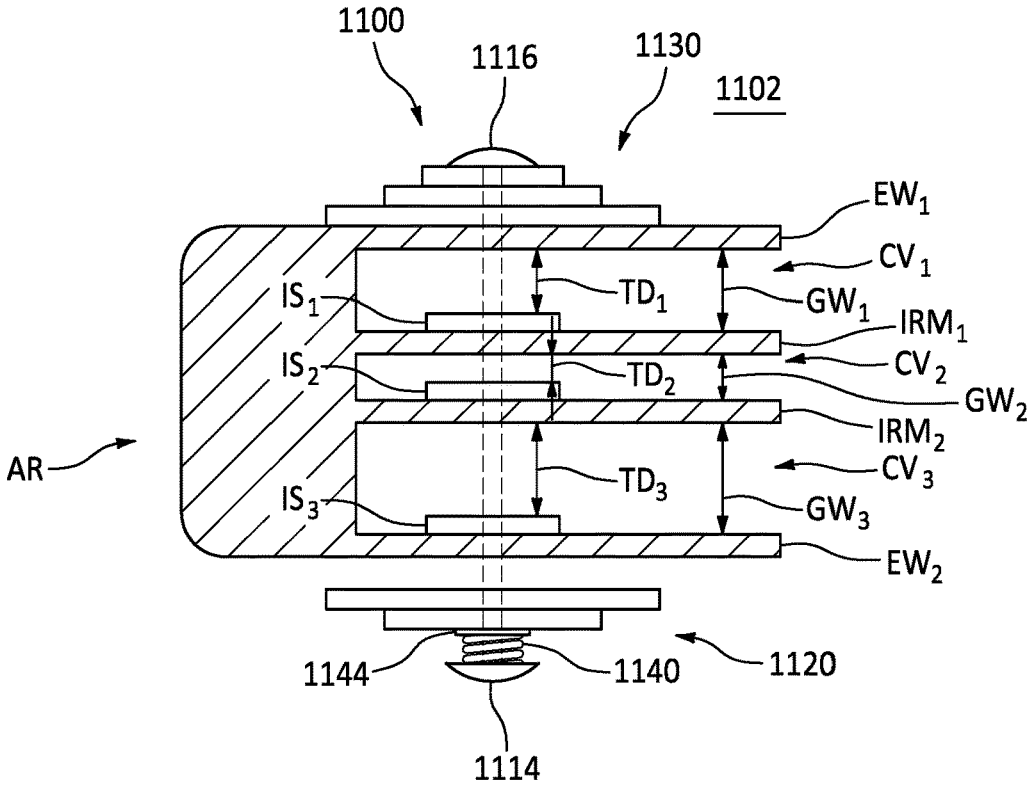
FIG. 14 is a side, partial cross-sectional view of a multi-layered shaker having various gap widths among its internal resonance members.

FIG. 14 is a side, partial cross-sectional view of a multi-layered shaker 1102, FIG. 14, has various gap widths $GW_1$, $GW_2$ and $GW_3$ among its internal resonance members $IRM_1$ and $IRM_2$ and exterior walls $EW_1$ and $EW_2$. Having gaps of slightly different widths provides different travel distances, represented by arrows $TD_1$, $TD_2$ and $TD_3$, which enables the internal strikers $IS_1$, $IS_2$ and $IS_3$ to hit the sound boards at slightly different times when played back and forth; hitting at slightly different times creates a fuller sound of longer duration and/or multiple frequencies, by layering the hits with a single motion of the shaker 1102.

Figure 15:
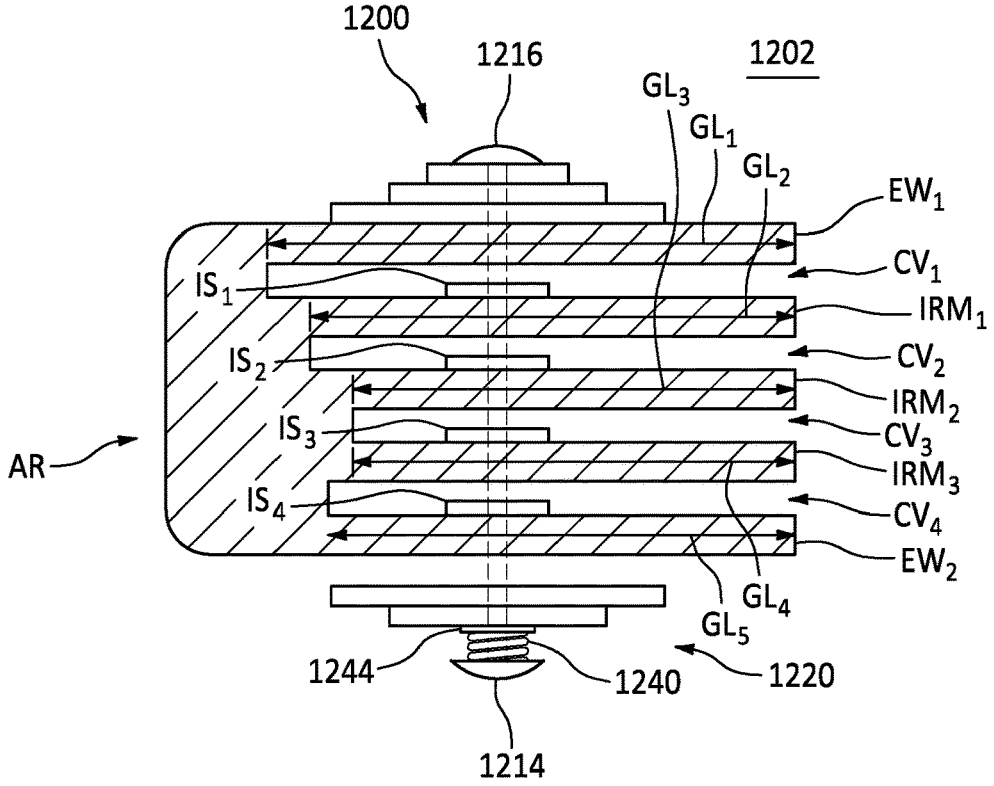
FIG. 15 is a side, partial cross-sectional view of a multi-layered shaker having various lengths of its internal resonance members.

A multi-layered shaker 1202, FIG. 15, has various lengths of its internal resonance members. The depth of each cavity (also referred to herein as a "cut" or "gap") in the body can vary, by creating different depth cuts it makes different tones when the striker hits the sound board. As illustrated in FIG. 15, gap length arrow $GL_1$ represents the depth of cavity $CV_1$ as well as the "free-standing" length of external wall $EW_1$. Gap length arrow $GL_2$ represents the depth of cavity $CV_2$. Gap length arrows $GL_3$ and $GL_4$ represents the depth of cavity $CV_3$. Gap length arrow $GL_5$ represents the depth of cavity $CV_1$ as well as the "free-standing" length of external wall $EW_2$. The deeper the cut, the lower the tone that will be produced by vibration of the respective sound board when struck by the respective internal striker $IS_1$, $IS_2$, $IS_3$ or $IS_4$. External striker sets 1220 and 1230 plus internal strikers $IS_1$, $IS_2$, $IS_3$ and $IS_4$ are secured by rod 1312.

Figure 16:
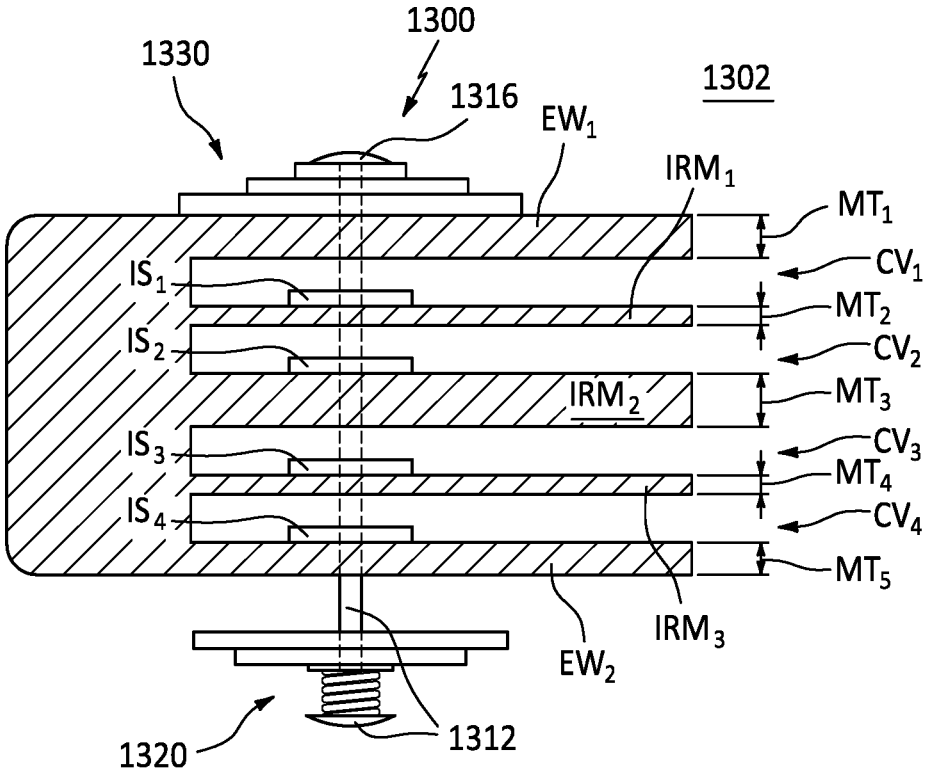
FIG. 16 is a side, partial cross-sectional view of a multi-layered shaker having various thicknesses of its internal resonance members.

A multi-layered shaker 1302, FIG. 16, has various member thicknesses $MT_1$, $MT_2$, $MT_3$, $MT_4$ and $MT_5$ of its external walls EW1, EW2 and internal resonance members $IRM_1$, $IRM_2$ and $IRM_3$. Response unit 1300 has external striker sets 1320 and 1330 plus internal strikers $IS_1$, $IS_2$, $IS_3$ and $IS_4$ which are secured by rod 1312.

Figure 17:
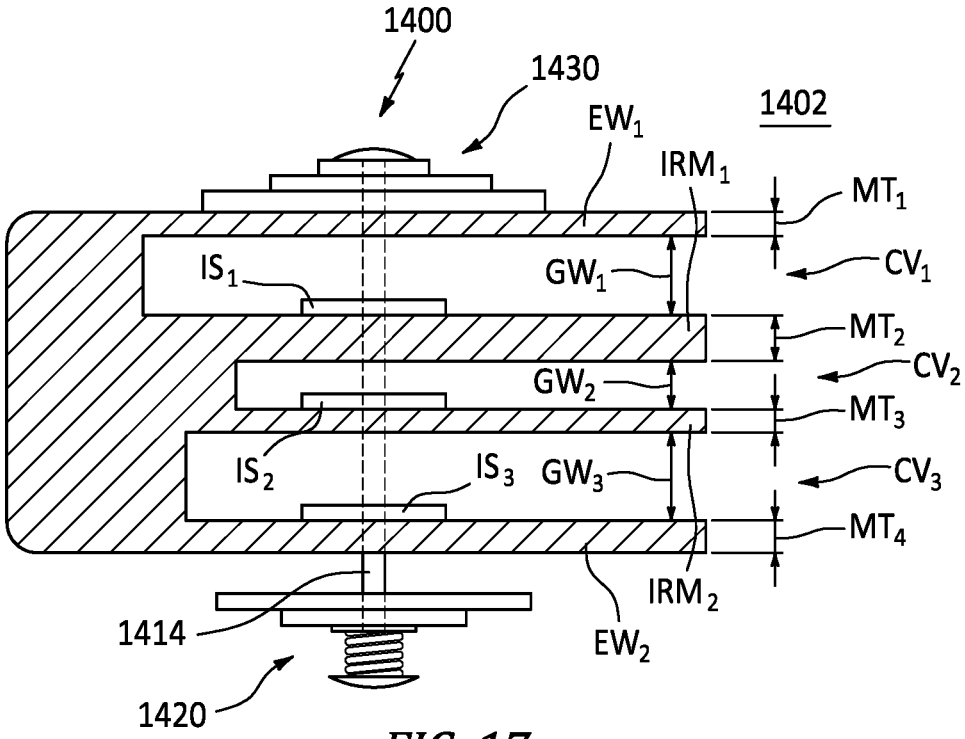
FIG. 17 is a side, partial cross-sectional view of a multi-layered shaker having a combination of various gaps, lengths and thicknesses.

Combination shaker 1402, FIG. 17, has a combination of various gaps, lengths and thicknesses. Response unit 1400 has external striker sets 1420 and 1430 plus internal strikers $IS_1$, $IS_2$, and $IS_3$ which are secured by rod 1412.

Figure 18:
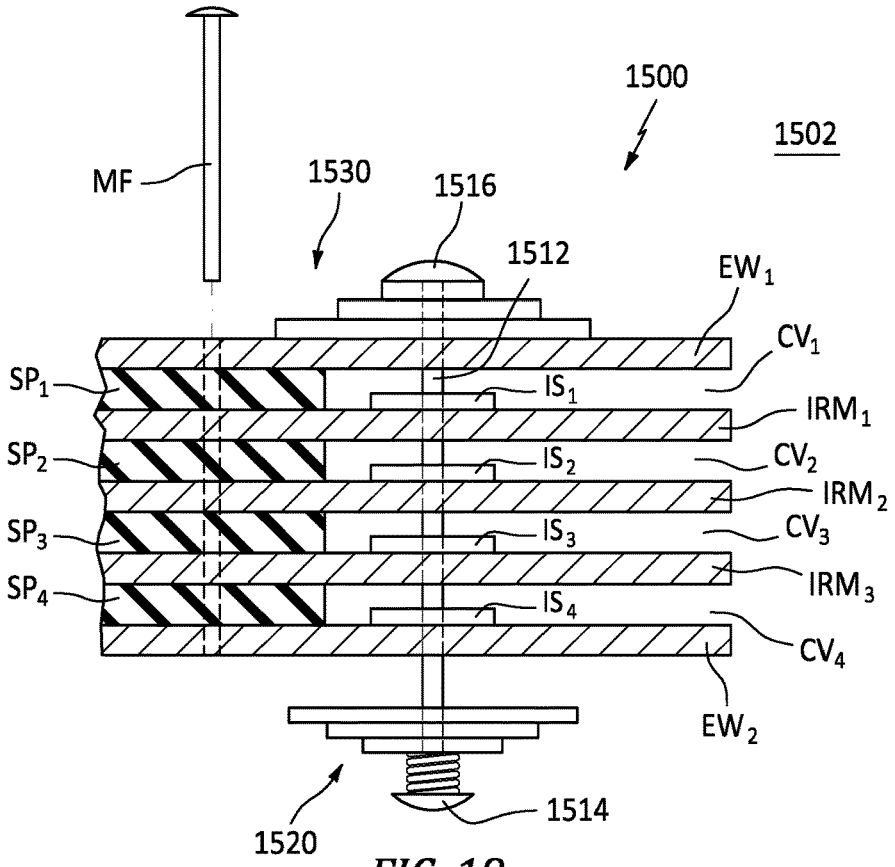
FIG. 18 is a side, partial cross-sectional view of a multi-component, multi-layered shaker formed of a plurality of materials.

A multi-component, multi-layered shaker 1502, FIG. 18, is formed of a plurality of materials. The body can be constructed out of wood, plastics, metal, ceramic etc. Utilizing different composites for different components of the body creates different sounds, as wood would have a lower pitch and more earthy sound, while metal would be more bright and metallic sound.

In some constructions, the body is formed by layering separate pieces such as discs serving as external walls EW1, EW2 and internal resonance members $IRM_1$, $IRM_2$ and $IRM_3$ with spacers SP1, SP2, SP3 and SP4 to create the gaps for cavities $CV_1$, $CV_2$, $CV_3$ and $CV_4$. This allows the use of different composites (a multi-composite body) to create different sounds. In some constructions, for example, the external (outer-most) discs are one or more types of wood and the internal disks sound boards are one or more types of polymers (plastic) having the same or different density, resilience, or other property of interest for the sound produced. By changing the composites, different sounds can be achieved.

In some constructions, the various components are secured together by a fastener MF, such as epoxy or other bonding element, a rivet, a bolt, a screw or a push-pin which frictionally engages external wall $EW_2$. Response unit 1500 has external striker sets 1520 and 1530 plus internal strikers $IS_1$, $IS_2$, $IS_3$ and $IS_4$ which are secured by rod 1512.

Figure 19:
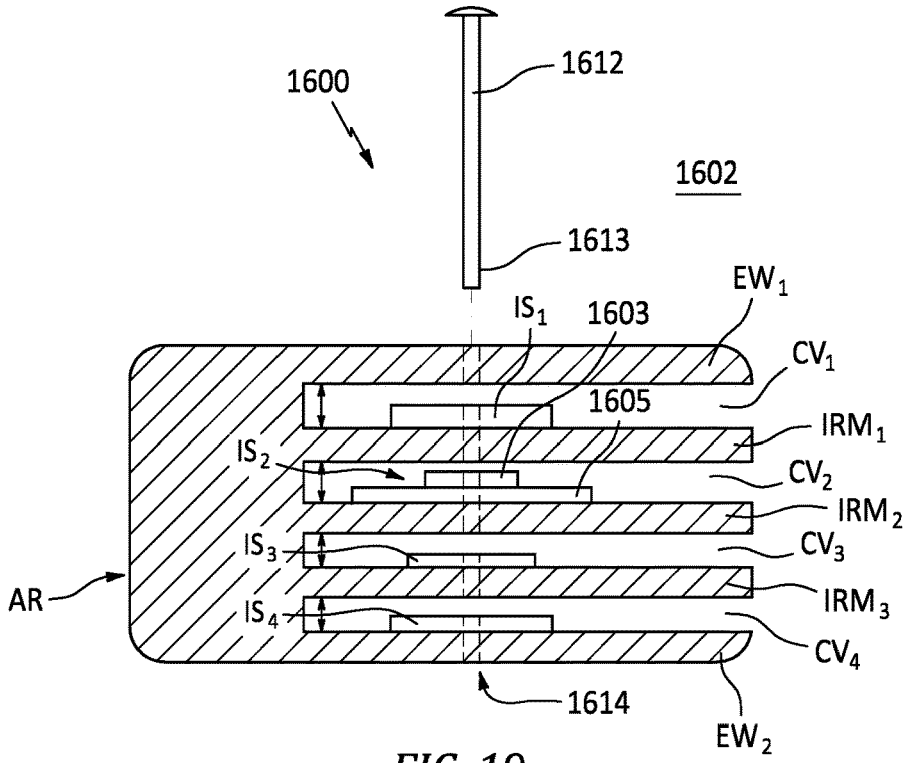
FIG. 19 is a side, partial cross-sectional view of a monolithic multi-layered shaker having only internal strikers.

One construction of a monolithic multi-layered shaker 1602, FIG. 19, has a response unit 1600 having only internal strikers $IS_1$, $IS_2$, $IS_3$ and $IS_4$ which are secured by rod 1612. In some constructions, one or more of strikers $IS_1$, $IS_2$, $IS_3$ and $IS_4$ have two or more washers, such as internal striker $IS_2$, having two washers 1603 and 1605 as illustrated in FIG. 19. In other words, multiple sizes and possible stacked washers can be utilized as internal strikers according to the present invention.

As mentioned above, in some constructions according to the present invention, a portion of a body of a percussion instrument serves as an enlarged feature of a retaining element, and an end of the rod has a frictional engagement with that portion of the body such as via a compression fit, a threadable engagement, or an adhesive attachment. As illustrated in FIG. 19, at least end 1613 of rod 1612 engages with a portion 1614 of external wall $EW_2$ to retain rod 1612 within body AR.

Figure 20:
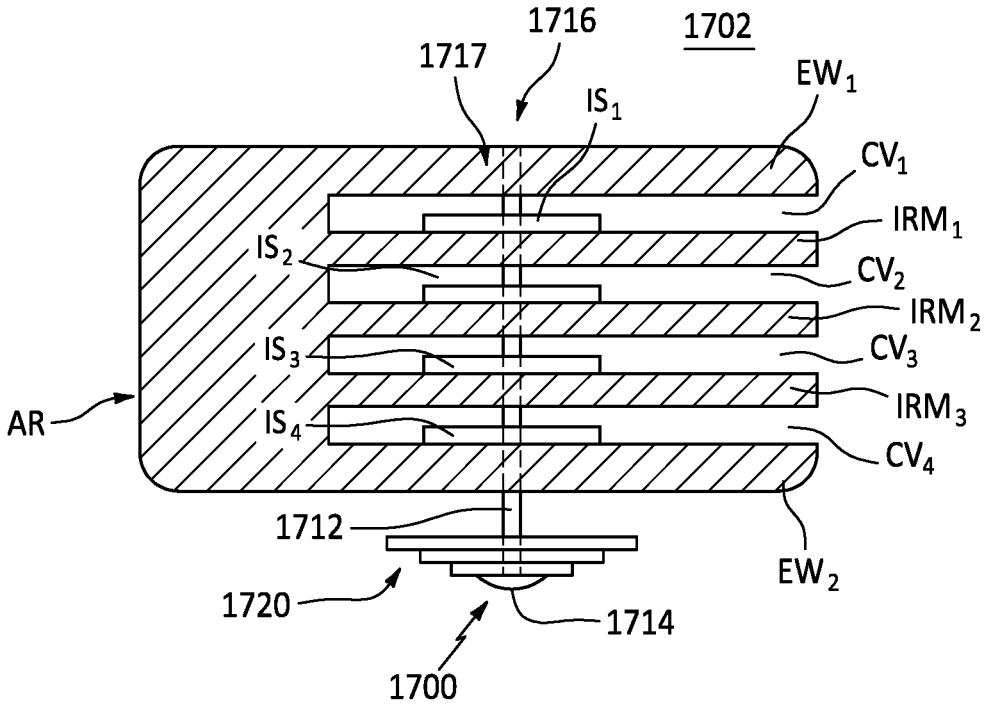
FIG. 20 is a side, partial cross-sectional view similar to FIG. 19 showing both internal and external strikers.

A shaker 1702, FIG. 20, has a response unit 1700 with both internal and external shakers. Response unit 1700 has one external striker set 1720 in this construction, secured by head 1714, plus internal strikers $IS_1$, $IS_2$, $IS_3$ and $IS_4$ which are secured by rod 1712. An end 1716 of rod 1712 engages with a portion 1717 of external wall $EW_1$ to retain rod 1712 within body AR.

A round shaker 1802, FIG. 21, is shown with a response unit 1800 having striker set 1830 with external strikers 1832, 1834 and 1836 offset in one direction and with no holes visible. Head 1816 covers the hole in striker 1832, while each of strikers 1832 and 1834 covers the hole in the striker beneath it. From a visual point of view as depicted in FIG. 21, people don't actually see the holes from the striker below each other, which creates a nice finished-looking product. A user can place one's thumb on the strikers and push them up so the edges all meet up to provide the player with the ability to control what strikers will move and when. Also, when the strikers are pushed up to be substantially even with each other such as at thumb rest position TR, one can actually hold the edge of the strikers with a single thumb or finger and allow the strikers to only contact each other while holding them against the body AR.

Although the body of acoustic resonator AR, FIG. 21, is shown as circular or "puck-shaped" when viewed from the top, this is not a limitation of the invention. In other constructions, shakers according to the present invention are symmetrical or asymmetrical polygonal shapes such as triangular, square, trapezoidal, rectangular, pentagonal, hexagonal, or other shape as desired. The body can also have any desired dimensions such as a selected length, width and/or overall size.

In summary, the "puck" constructions illustrated in FIGS. 13-21 can also be expressed as a puck-shaped hand instrument comprising a body with multiple internal resonance cavities established by one or more internal resonance members, also referred to as internal sound boards, that get struck by at least one striker when the instrument is moved in at least one direction, such as back and forth. Typically, the sound boards are very close together so this creates a very tight sound. In a number of constructions, a biasing member such as a spring is disposed near an end of the rod which creates additional action in the instrument: the more forcefully the instrument its played, the more response in the return stroke you get also by pushing to release tension on the spring it allows more movement on the external shakers which can by controlled to create rhythms. The strikers are held in place by a rod that passes through the center of each striker and through the body, strikers on the outside of the body being held in place by under the head of the rod, when playing the rod that can be push on to allow more movement on the external strikers and released to allow less movement being able to control how much they can move.

In some constructions, the rod has a spring on one end (but could be on both ends or none) between the external strikers and the head of the rod when played in a back and forth motion the spring creates action in the instrument and also controls the amount of movement that the external strikers can move, a skilled player can create the amount of movement on the external strikers by the action on the spring without depressing the rod as well. Pressing on the rod allows even more back-and-forth moment on the external strikers which can be controlled in real time.

By pressing on the rod and allowing more movement of the external strikers, a skilled player can create more volume and accents by controlling the amount of movement is which the strikers can move. As the strikers slide on the rod a skilled player can have a balance of sound between a metallic and wood (earthy), by the amount the strikers hit the rod versus the amount the strikers hit the body, this is achieved by combining a back-and-forth motion to a up-and-down motion by a skilled player.

Typically, the rod is constructed in two parts: the rod portion with a head at one end; and the screw with a head which is removably secured to the opposite end of the rod. In another construction, the rod has a male- or female-threaded connector at each end to removably secure a head at each end. In other, monolithic constructions made out of one piece of material, the heads of the rod are finished to be larger than the holes in the outermost exterior strikers to retain the strikers in and on the body. Preferably, the hole in the body is slightly larger than the rod this allows the rod to rattle in the body which can be controlled by a skilled player.

The shape of the body allows each sound board to be supported or connected to the body on one side only, but could be connected in multiple areas to enable more action and clarity to the instrument.

The external strikers can naturally flap back and forth when played in a back-and forth motion, by holding your hand on them a skilled player can create rhythmic patterns by muting and releasing their action.

Also, the rod may be fixed on one or both ends to the body, with enough space to allow free movement of the external strikers. The more force put into the back-and-forth motion when playing, the louder the strikers hit the body. By laying one's fingers/thumb on the strikers and restricting their movement by varying degrees, a skilled player can control the impact force of the strikers upon the body from non-existent to a full unobstructed hit.

Holding the body in the palm of one's hand, a skilled player can create a different type of sound by opening and closing your hand around the body when being played. When one's hand is closed, it creates a hollow type sound; when you open your hand up its changes to a slightly higher pitched up front sound, this difference can be controlled and implemented in the art of music.

The spring-action rod and striker assembly can be incorporated into any hand-held rhythm shaker, such as a bead-filled hand shaker. Spring action enables the instrument to have live action: as the spring bounces back and forth on the rod, it cushions the strikers from hitting the end of the rod and thereby produces a muted sound; this muting with live sound from the other strikers can be controlled by a skilled player.

In some constructions, the rhythm shaker has multiple spring action assemblies, as this enables a skilled player to mute by holding one's finger or thumb lightly on the strikers and allow the striker stacks and/or the other striker assembly to move freely. By blending the two sounds a skilled player can create multiple rhythms and sounds at one time.

The spring action rod striker assembly can also be used without a spring, which enables the rod itself to slide back and forth when played. The head of the rod thereby directly hits the top of the strikers.

Figure 22:
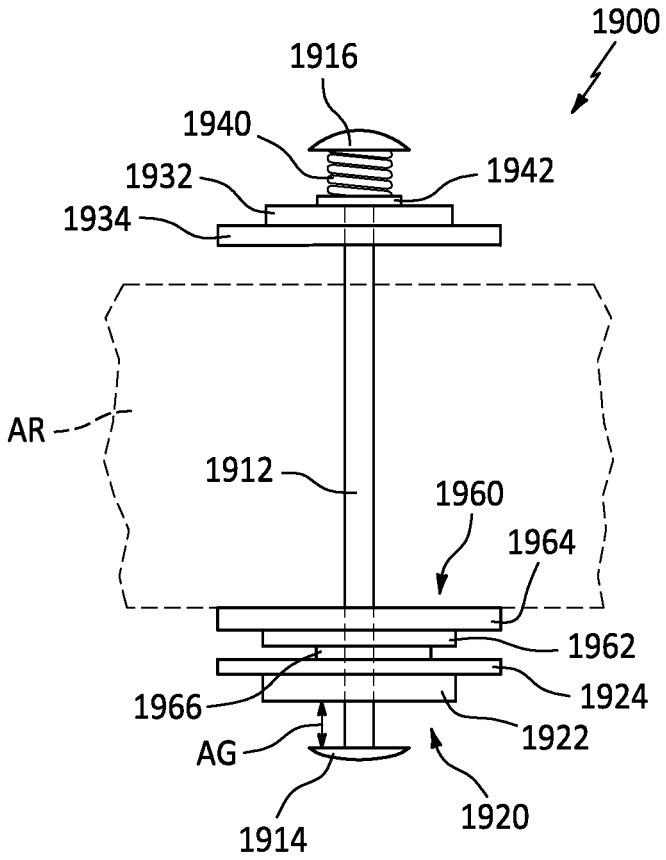
FIG. 22 is a schematic side elevational view of yet another percussive response unit according to the present invention having multiple retaining heads.

In yet another construction as illustrated in FIG. 22, more than one striker set is established near at least one end of a rod. Response unit 1900 has one striker set 1920 with strikers 1922 and 1924 held between heads 1914 and 1966 with air gap AG within set 1920. Another striker set 1960 has strikers 1962 and 1964 bounded between head 1966 and body AR, shown in dashed lines. Movement of strikers 1962 and 1964 is enabled when coil spring 1940 is compressed relative to finish washer 1942 and strikers 1932, 1934 of striker set 1930 and head 1916 at the other side of body AR. It will be readily apparent after reviewing this disclosure that three, four or more striker sets can be fabricated for one or both ends of a response unit according to the present invention.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated, such as "mixing and matching" external strikers and/or internal strikers with different acoustic resonator body configurations. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art after reviewing the present disclosure and are within the following claims.

What is claimed is:

1. A percussive response unit suitable for installation on an acoustic resonator of a percussion instrument, the response unit comprising:

a rod having a rod shaft with a first rod end and a second rod end, and a first retaining element disposed at the first rod end and having a first head width, the shaft having an outer shaft diameter;

a first striker set of at least one striker disposed along a first portion of the rod shaft and positionable near the first head, each striker defining an opening that is larger than the outer shaft diameter to enable movement in at least one direction; and a second retaining element connected to the second rod end to secure the first striker set on the rod shaft.

2. The response unit of claim 1 wherein the second retaining element includes a second head having a second head width, and further including a second striker set of at least one striker disposed along a second portion of the rod shaft and positionable near the second head, each striker defining an opening that is larger than the outer shaft diameter and smaller than the second head width.

3. The response unit of claim 2 wherein the second striker set has at least two strikers, and each of at least two of the strikers in each striker has a flat surface, and the flat surface of one striker is arranged to contact the flat surface of the other striker.

4. The response unit of claim 3 wherein each of at least two of the strikers in each striker set is a planar disk defining a first flat surface on one side and a second flat surface on an opposing side of the disk.

5. The response unit of claim 3 wherein at least two of the strikers in each striker set have widths that are different from each other.

6. The response unit of claim 2 wherein each striker set has a first-width striker and a second-width striker, the second-width striker being positioned along the rod shaft farther from the respective head than the first-width striker and the second-width striker having a larger width than the first-width striker.

7. The response unit of claim 3 wherein at least one of the strikers in each striker set is a circular metal washer.

8. The response unit of claim 1 wherein at least one of the first retaining element and the second retaining element are selectively removable from the rod and re-attachable to the rod to enable installation and/or replacement of at least one striker.

9. The response unit of claim 1 further including at least a first biasing member positioned along an active portion of the rod shaft.

10. The response unit of claim 9 wherein the first biasing member is a coil spring which surrounds the active portion of the rod shaft.

11. The response unit of claim 9 wherein a portion of the first biasing member is adapted to contact one of the first retaining element and the second retaining element.

12. A percussion instrument comprising:

an acoustic resonator defining at least a first passageway having a first passageway diameter and extending between a first resonator surface and a second resonator surface;

at least a first percussive response unit including: (A) a rod positioned in the first passageway, having a rod shaft with a first rod end and a second rod end, having a rod longitudinal axis, and having a first retaining element disposed at the first rod end and having a first head width, the shaft having an outer shaft diameter that is accommodated by the first passageway diameter; (B) a first striker set of at least one striker positionable along a first length of the rod shaft and near the first retaining element, each striker defining an opening that is larger than the outer shaft diameter and smaller than the first head width; and (C) a second retaining element connected to the second rod end to secure the first striker set on the rod shaft; and wherein an air gap is established along at least a portion of the rod shaft to enable at least one striker to move at least one of (i) transversely to the rod longitudinal axis and/or (ii) axially along the rod longitudinal axis.

13. The percussion instrument of claim 12 wherein the second retaining element includes a second head having a second head width, and further including (D) a second striker set of at least one striker positionable along a second length of the rod shaft, each striker defining an opening that is larger than the outer shaft diameter.

14. The percussion instrument of claim 12 wherein the first passageway is defined by a solid portion of the acoustic resonator, and the first resonator surface is a first outer surface of the resonator, and the second resonator surface is a second outer surface of the resonator.

15. The percussion instrument of claim 12 wherein the first passageway has a first resonator opening defined by a first resonator wall and a second resonator opening defined by a second resonator wall, and at least a first chamber is defined between the first resonator wall and the second resonator wall.

16. The percussion instrument of claim 13 wherein each striker set has a first-width striker and a second-width striker, the second-width striker being positioned along the rod shaft closer to the acoustic resonator and farther from the respective head than the first-width striker, and the second-width striker having a larger width than the first-width striker.

17. The percussion instrument unit of claim 12 further including at least a first biasing member positioned along an active portion of the rod shaft.

18. A percussion instrument having multiple internal resonance cavities, comprising:

an acoustic resonator defining at least a first passageway having a first passageway diameter and extending between a first outer wall having a first external surface and a second outer wall having a second external surface;

at least one internal resonance member extending transversely to the first passageway and having (i) a first resonator surface defining a first resonance cavity between the first outer wall and the first resonator surface and (ii) a second resonance surface bounding a portion of a second resonance cavity;

a rod having a rod shaft extending along the first passageway and having a first rod end and a second rod end; and at least a first internal striker positioned along the rod shaft and in the first resonance cavity or in the second resonance cavity.

19. The percussion instrument of claim 18 wherein the rod has a first head disposed at the first rod end and having a first head width, the shaft having an outer shaft diameter that is accommodated by the first passageway diameter; (B) a first striker set of at least one striker positionable along a first length of the rod shaft and near the first head, each striker defining an opening that is larger than the outer shaft diameter and smaller than the first head width; and (C) a retaining element connected to the second rod end to secure the first striker set and the first internal striker on the rod shaft.

20. The percussion instrument of claim 18 further including at least one striker set positionable to strike one of the first external surface and the second external surface of the acoustic resonator, and wherein an air gap is established along at least a portion of the rod shaft to enable at least one striker to move at least one of (i) transversely to the rod longitudinal axis and/or (ii) axially along the rod longitudinal axis.

* * * * *